US006346676B1

(12) United States Patent
Caldwell

(10) Patent No.: US 6,346,676 B1
(45) Date of Patent: Feb. 12, 2002

(54) ELECTRICAL CABLE

(75) Inventor: Barry Caldwell, Hesston, KS (US)

(73) Assignee: LSI Logic Corporation, Milpitas, CA (US)

( * ) Notice: Subject to any disclaimer, the term of this patent is extended or adjusted under 35 U.S.C. 154(b) by 0 days.

(21) Appl. No.: 09/546,818

(22) Filed: Apr. 11, 2000

(51) Int. Cl.[7] ..... H01B 7/08
(52) U.S. Cl. ..... 174/117 F; 439/404
(58) Field of Search ..... 174/117 F, 117 M; 439/404, 405, 498

(56) References Cited

U.S. PATENT DOCUMENTS 4,429,940 A * 2/1984 Freshwater et al. ..... 439/404
5,194,014 A * 3/1993 McClune et al. ..... 439/404
5,727,962 A * 3/1998 Caveney et al. ..... 439/404 X
5,902,146 A * 5/1999 Hanami ..... 439/405

* cited by examiner

*Primary Examiner*—Chau N. Nguyen
(74) *Attorney, Agent, or Firm*—Suiter & Associates

(57) ABSTRACT

An electrical cable suitable for transmission of data signals cable includes a dual layer ribbon cable with a first layer being offset from the other layer by an offset distance. The dual layer ribbon construction of the cable allows the cable to be compliant with a SCSI standard and to include a VHDCI compliant connector. The cable may have a first Z form where a spacer connects an insulator in the first layer with an insulator in the second layer, a second form in which an insulator of the first layer is attached to an insulator in the second layer, or a modified second form in which a spacer is attached between adjacent insulators in the same layer. The double layer ribbon cable construction allows the width of the cable to be reduced to accommodate a smaller pitched, larger pin number VHDCI compliant connector anywhere along the length of the cable. It is emphasized that this abstract is provided to comply with the rules requiring an abstract that will allow a searcher or other researcher to quickly ascertain the subject matter of the technical disclosure. It is submitted with the understanding that it will not be used to interpret or limit the scope or meaning of the claims. 37 CFR 1.72(b).

11 Claims, 2 Drawing Sheets

ELECTRICAL CABLE

BACKGROUND

Current Small Computer System Interface (SCSI) ribbon cables are 25 or 50 millimeters center-to-center spacing using 28 AUG wire for use with an insulation displacement cable (IDC) compliant press through connectors in accordance with the SCSI Parallel Interface specification 3 (SPI 3). Current designs do not allow such a cable to be utilized with a Very High Density Cable Interconnect (VHDCI) connector using a ribbon cable without requiring a printed wiring board (PWB) card as a mount for the VHDCI connector. Thus, there lies a need for a SCSI compliant ribbon cable that is capable of utilizing a VHDCI connector.

BRIEF DESCRIPTION OF THE DRAWINGS

The numerous advantages of the present invention may be better understood by those skilled in the art by reference to the accompanying figures in which.

DETAILED DESCRIPTION

Reference will now be made in detail to the presently preferred embodiment of the invention, an example of which is illustrated in the accompanying drawings.

Figure 1:
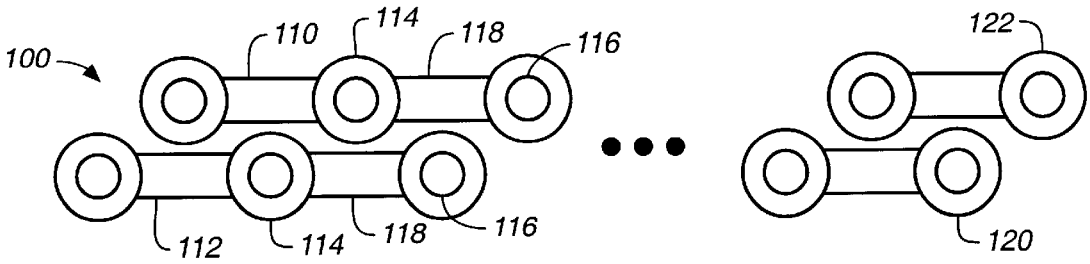
FIG. 1 is an elevation end view of a ribbon cable configuration in accordance with the present.

Referring now to FIG. 1, a ribbon cable configuration of an electrical cable in accordance with the present invention will be discussed. Cable 100 is a double layer ribbon configuration as shown. Cable 100 includes a first layer 110 and a second layer 112. Each layer 110 and 112 includes at least two or more conductors 116 that are electrically conductive for transmitting electrical signals via cable 100. Each conductor 116 is encapsulated by an insulator 114 which provides electrical insulation of conductors 116 and isolation of one conductor 116 from electrical contact with an adjacent conductor 116. Each of conductors 116 is separated by a predetermined distance 118. The structure defining predetermined distance 118 in one embodiment is a continuation of insulator 114 of two adjacent conductors 116 so that a continuous, generally planar structure is formed. In one embodiment, insulators 114 and predetermined distance 118 structures of both first and second layers 110 and 112 are formed into a single, continuous insulator 114 structure. As shown in FIG. 1, first layer 110 is offset from second layer 112 by an offset distance so that a conductor 116 of one of layers 110 and 112 is generally disposed between two adjacent conductors 116 of the other layer of layers 110 and 112, thereby causing cable 100 to have a double layer ribbon cable configuration where one layer is offset from the other layer. The offset distance in one embodiment is approximately one half of predetermined distance 118. Conductors 116 and insulator 114 in one embodiment are fabricated from a material that provides both the desired respective electrical properties, for example conductivity, dielectric insulation, an so on, and desired respective physical properties such as flexibility such that cable 100 is at least a partially flexible structure. The number of conductors 116 in first and second layers 110 and 112 is dependent upon the number of conductive paths required for the particular application of cable 100. Thus, in one embodiment cable 100 includes in total N conductors 116, with the Nth conductor 122 being disposed in one of said first and second layers 110 and 112, and the (N−1)th conductor 120 being disposed in the other of said first and second layers 110 and 112. One embodiment of the present invention contemplates cable 100 being compliant with a (SCSI) standard, for example SCSI-5. In one embodiment, the total number N of conductors 116 is 68 such that conductor 122 is the 68th conductor and conductor 120 is the 67th conductor.

Figure 2:
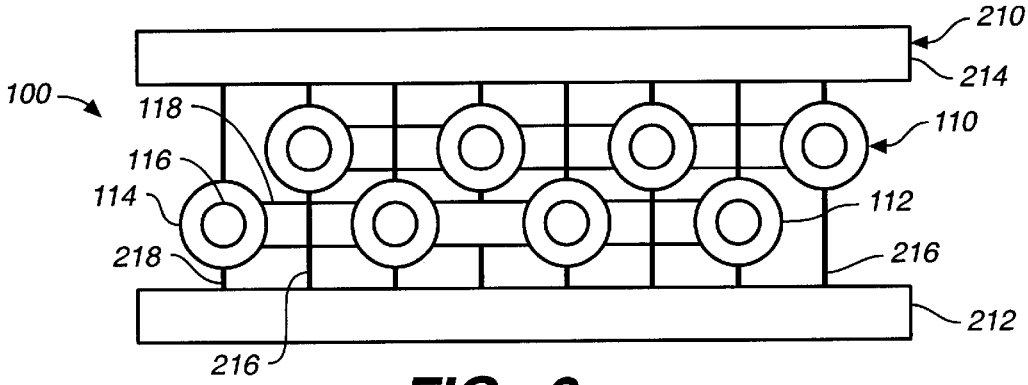
FIG. 2 is an elevation end view of the ribbon cable of FIG. 1 further showing the coupling of the ribbon cable with a VHDCI compliant connector in accordance with the present invention.

Referring now to FIG. 2, a diagram of the cable of FIG. 1 in which a connector in accordance with the present invention will be discussed. Connector 210 is shown coupling with first and second layer 110 and 112 of cable 100 so that cable 100 is capable of connecting to a device intended to send or receive signals via cable 100 and which has a like connector or receptacle capable of mating with connector 210 such that electrical and physical coupling between cable 100 and the device is provided. Connector 210 generally comprises a bottom 214 and an offside pressure plate 212 that is capable of mating with bottom 214. Bottom 214 includes an array of pins 216 where each pin 216 is intended to couple with a respective one of conductors 116 of cable 100. One of pins 216 penetrates through an insulator 114 of first layer 110 and makes physical and electrical contact with the respective conductor 116 that the insulator 114 encapsulates, without contacting any other conductor 116 of either first layer 110 or second layer 112. Similarly, another pin 216 penetrates through a predetermined distance structure 118 of first layer 110 without contacting any of the conductors 116 of first layer and penetrates through an insulator 114 of second layer 110 and makes physical and electrical contact with the respective conductor 116 of second layer 112 without contacting any other conductor of second layer 112. In such a configuration, only one pin 216 in the array of pins of bottom 214 contacts a respective one of conductors 116 of cable 100, one pin 216 for each respective conductor 116. It should be noted that in some embodiments of cable 100, the number of pins 216 need not equal the number of conductors 116, for example cable 100 may include 68 conductors 116 but connector 210 may include only 48 pins, depending upon the particular desired configuration of cable 100 and without providing substantial change to the function of cable 100. Pressure plate 212 includes an array of receptacles 218 corresponding to the array of pins 216 of bottom 214 such that pins 216 insert into a respective receptacle 218 to secure pins 216, for example to retain and to prevent lateral movement of pins 216. Thus, connector 210 couples with cable 100 by bringing bottom 214 together with pressure plate 212 thereby causing pins 216 to penetrate corresponding insulators 114 and contact a respective conductor 116 of first layer 110 or second layer 112. In one embodiment, connector 210 is compliant with a Very High Density Cable Interconnect (VHDCI) standard, and is an (IDC) type connector. In one embodiment, connector 214 is a VHDCI compliant connector that provides 0.8 millimeter spacing and 68 pins 216 and respective contacts and is suitable for use with SCSI-5compliant cable such that cable 100 is so compliant. As such, cable 100 is compatible with an Ultra-Wide SCSI standard and is suitable for utilization with Redundant Array of Independent Disks (RAID) type controllers. By using a double layer offset ribbon cable, the center-to-center spacing can be reduced to a range such that a SCSI VHDCI connector 210 can be constructed that can mount onto cable 100 at either end of cable 100 or in the middle at a location disposed between either end. By providing a double layer, offset ribbon cable, the center-to-center spacing of cable 100 is thereby capable of being reduced by approximately one-half that of a single layer ribbon cable, and the IDS pitch process of VHDCI connector 210 is thereby capable of being maintained at a lower size to match a 0.8 millimeter pitch in such a connector 210. In addition, cable 100 is capable of being manufactured using current technologies with only slight modification to present tooling. The double layer offset ribbon construction of cable 100 a reduced with center to center spacing allows for an IDC or "vampire" type piercing between first and second layers 110 and 112 of insulation 114 enclosed wire strand conductors 116.

Figure 3:
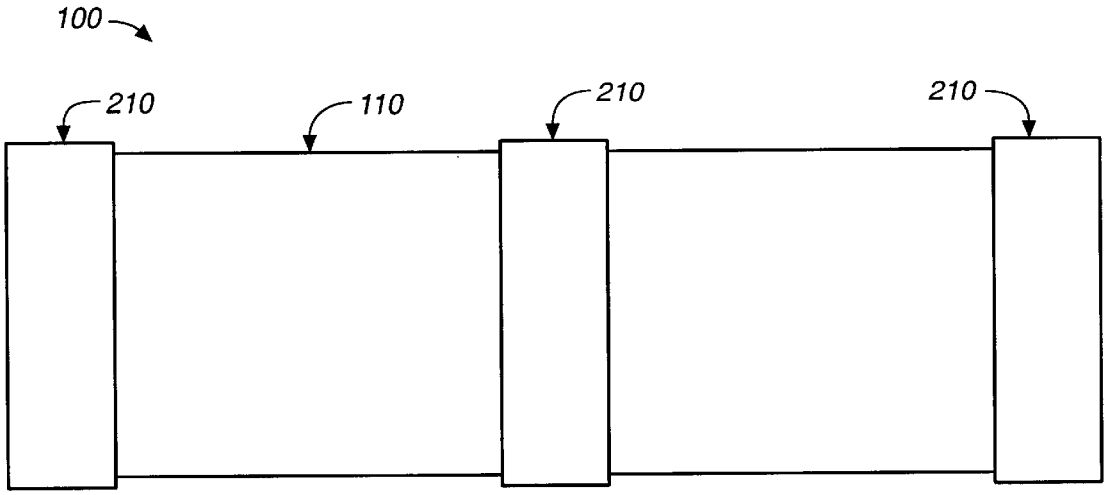
FIG. 3 is a top plan view of the ribbon cable of FIG. 1, showing a VHDCI compliant connector at either end thereof, and a VHDCI compliant connector coupled to the ribbon cable at a position between either end in accordance with the present invention.

Referring now to FIG. 3, a top plan view of the cable shown in FIGS. 1 and 2. As can be seen in FIG. 3, cable 100 is capable of coupling with connector 210 at either end of cable 100. Further, conductor 210 is capable of being disposed at any interior position along the length of cable 100 between either end thereof. Such configuration of cable 100 may be achieved by bringing bottom 214 together with pressure plate 212 at the desired location of connector 210 along the length of cable 210. Each of first and second layers 110 and 112 is generally planar yet each of first and second layers 110 and 112 can be distorted out of the plane due to the flexibility of insulators 114 and conductors 116, for example through twisting, warping, rolling, etc. without affecting the operation of cable 100 and to accommodate the span path and distance between two devices coupled by cable 100, for example.

Figure 4A:
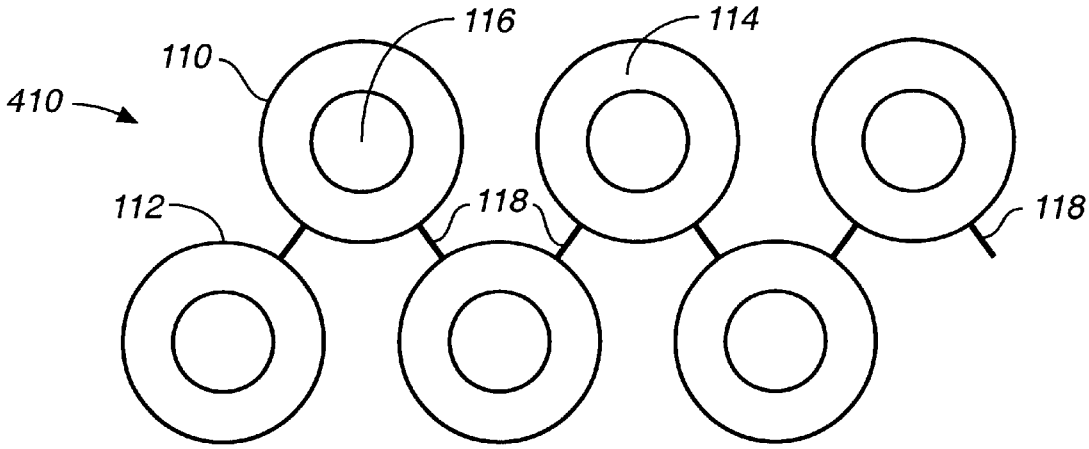
FIGS. 4A, B and C are an end view diagram of alternative configurations of the cable shown in FIG. 1.
Figure 4B:
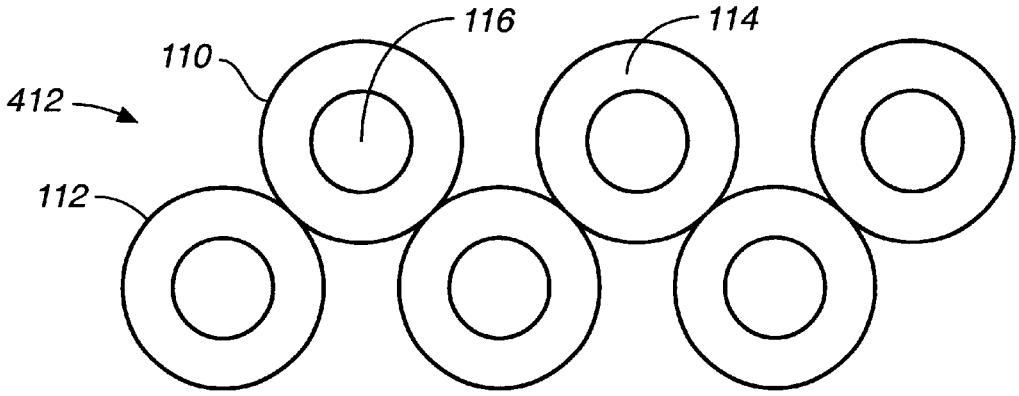
Figure 4C:
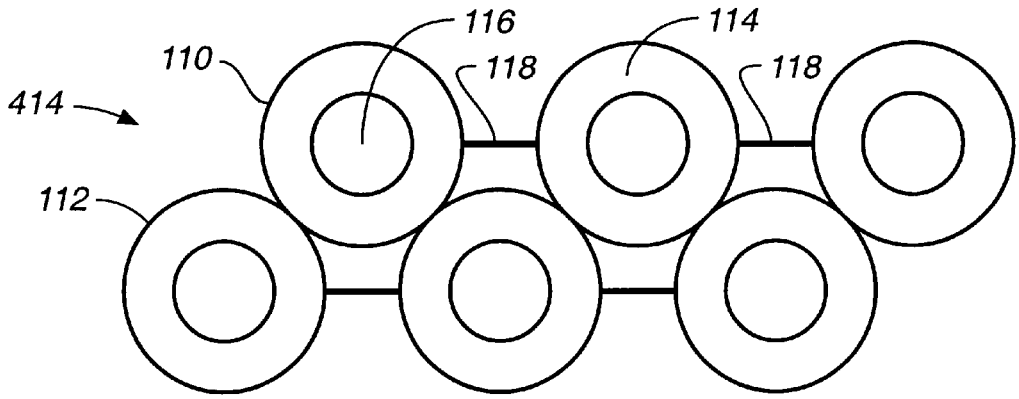

Referring now to FIGS. 4A, 4B, and 4C, alternative configurations of the ribbon cable as shown in FIG. 1 capable of being utilized with electrical cable in accordance with the present invention will be discussed. The configurations of cable 410, 412, and 414 as shown in FIGS. 4A, 4B, and 4C are substantially similar to the configuration of cable 100 as shown in FIG. 1 and couple with pins 216 and 316, and with bottom plate 214 and pressure plate 212 of connector 210 as discussed herein and as shown in FIG. 2. Cable 410 is a double stack Z-form cable having first and second layers 110 and 112, respectively, that allows cable 410 to stack up tightly while providing flexibility for lateral expansion when pins 216 of connector 210 are inserted and pierce through insulation 114 sheath and through spacers 118. Spacers 118 couple an insulation 114 sheath of a first layer 110 to adjacent insulation 114 sheaths of the second layer 112, and vice-versa as shown in FIG. 4A. Such a design of cable 410 is capable of being manufactured using extrusion technology. Cable 412 of FIG. 4B has a double stacked form comprising first and second layers 110 and 112, respectively, where insulation 114 sheaths are extruded with very little or no spacers 118. Such a configuration of cable 412 provides a more rigid spacing of conductors 116 where it is desired that the positions of conductors 116 and the overall structure of cable 412 are more strictly controlled. Cable 414 of FIG. 4C has a double stacked form comprising first and second layers 110 and 112, respectively, where spacers 118 of cable 414 are formed such that insulation 114 sheathing provides a center-to-center spacing of conductors 116 to allow pins 216 to pierce through insulation 114 with a more controlled spacing and structure of conductors 116. Spacers 118 between adjacent insulation 114 sheaths of the same layer, 110 or 112, provide a higher lateral strength to provide a higher center-to-center spacing tolerance between conductors 116. Cable 100 and connector 210 may be compliant with any parallel bus or connector and termination technology or standard, including but not limited to Small Computer System Interface (SCSI), Integrated Device Electronics (IDE), Advanced Technology Attachment (ATA), Insulation Displacement Cable (IDC), Insulation Displacement Termination (IDT), Very High Density Cable Interconnect (VHDCI), and Intelligent Peripheral Interface (IPI).

It is believed that the electrical cable of the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A cable, comprising:

first and second layers, each of said first and second layers being generally flexibly planar and including two or more conductors aligned in a plane of said respective first and second layers, each one of said two or more conductors of each of said first and second layers being encapsulated by an insulator and being separated from an adjacent conductor by a predetermined distance, said first layer being planarly stacked against said second layer and being offset from said second layer by an offset distance, said two or more conductors of said first layer being substantially parallel to said two or more conductors of said second layer; and a connector disposed at a position along said first and second layers, said connector having at least two pins disposed generally perpendicular to a plane in which at least part of said first and second layers is disposed, one of said at least two pins coupling with one of said two or more conductors of said first layer and another of said at least two pins coupling with one of said two or more conductors of said second layer, at least one of said at least two pins penetrating through one of said first and second layers without contacting any of said two or more conductors of the other of said first and second layers to couple with one of said two or more conductors of the other of said first and second layers.

2. A cable as claimed in claim 1, said connector capable of being disposed at an end of said first and second layers.

3. A cable as claimed in claim 1, said connector capable of being disposed at an interior position of said first and second layers between a first and a second end of said first and second layers.

4. A cable as claimed in claim 1, said connector being compliant with a parallel bus standard.

5. A cable as claimed in claim 1, said connector being compliant with at least one standard selected from the group consisting of SCSI, IPI, IDE, IDT, ATA, VHDCI, and IDC.

6. A cable as claimed in claim 1, said first and second layers being compliant with a parallel bus standard.

7. A cable as claimed in claim 1, said first and second layers being compliant with at least one standard selected from the group consisting of SCSI, IPI, IDE, IDT, ATA, VHDCI, and IDC.

8. A cable as claimed in claim 1, the offset distance being approximately one half of the predetermined distance.

9. A cable, comprising:

first and second layers, each of said first and second layers being generally flexibly planar and including two or more conductors aligned in a plane of said respective first and second layers, each one of said two or more conductors of each of said first and second layers being encapsulated by an insulator and being separated from an adjacent conductor by a predetermined distance, said first layer being planarly stacked against said second layer and being offset from said second layer by an offset distance, said two or more conductors of said first layer being substantially parallel to said two or more conductors of said second layer;

a connector disposed at a position along said first and second layers, said connector having at least two pins disposed generally perpendicular to a plane in which at least part of said first and second layers is disposed, one of said at least two pins coupling with one of said two or more conductors of said first layer and another of said at least two pins coupling with one of said two or more conductors of said second layer, at least one of said at least two pins penetrating through one of said first and second layers without contacting any of said two or more conductors of the other of said first and second layers to couple with one of said two or more conductors of the other of said first and second layers, and at least one or more spacers, at least one of said one or more spacers connecting said insulator of a conductor of said two or more conductors of said first layer with said insulator of a conductor of said two or more conductors of said second layer.

10. A cable, comprising:

first and second layers, each of said first and second layers being generally flexibly planar and including two or more conductors aligned in a plane of said respective first and second layers, each one of said two or more conductors of each of said first and second layers being encapsulated by an insulator and being separated from an adjacent conductor by a predetermined distance, said first layer being planarly stacked against said second layer and being offset from said second layer by an offset distance, said two or more conductors of said first layer being substantially parallel to said two or more conductors of said second layer;

a connector disposed at a position along said first and second layers, said connector having at least two pins disposed generally perpendicular to a plane in which at least part of said first and second layers is disposed, one of said at least two pins coupling with one of said two or more conductors of said first layer and another of said at least two pins coupling with one of said two or more conductors of said second layer, at least one of said at least two pins penetrating through one of said first and second layers without contacting any of said two or more conductors of the other of said first and second layers to couple with one of said two or more conductors of the other of said first and second layers, and at least two or more spacers, at least one of said two or more spacers connecting said insulator of a conductor of said two or more conductors of said first layer with an adjacent insulator of a conductor of said two or more conductors of said first layer, and at least another of said two or more spacers connecting said insulator of a conductor of said two or more conductors of said second layer with an adjacent insulator of a conductor of said two or more conductors of said second layer.

11. A cable, comprising:

first and second layers, each of said first and second layers being generally flexibly planar and including two or more conductors aligned in a plane of said respective first and second layers, each one of said two or more conductors of each of said first and second layers being encapsulated by an insulator and being separated from an adjacent conductor by a predetermined distance, said first layer being planarly stacked against said second layer and being offset from said second layer by an offset distance, said two or more conductors of said first layer being substantially parallel to said two or more conductors of said second layer; and a connector disposed at a position along said first and second layers, said connector having at least two pins disposed generally perpendicular to a plane in which at least part of said first and second layers is disposed, one of said at least two pins coupling with one of said two or more conductors of said first layer and another of said at least two pins coupling with one of said two or more conductors of said second layer, at least one of said at least two pins penetrating through one of said first and second layers without contacting any of said two or more conductors of the other of said first and second layers to couple with one of said two or more conductors of the other of said first and second layers, wherein at least one insulator of a conductor of said two or more conductors of said first layer contacts at least one insulator of a conductor of said two or more conductors of said second layer.

* * * * *